US005354047A

United States Patent [19]

Chesnutt et al.

[11] Patent Number: 5,354,047

[45] Date of Patent: Oct. 11, 1994

[54] METHOD FOR SEPARATING A SHEET FROM AN ARRAY OF SHEETS CONVEYED ALONG A VACUUM CONVEYOR USING DIVERTING NOZZLES

[75] Inventors: Doyle D. Chesnutt, Williamsville; James A. Holler, Tonawanda, both of N.Y.; Arnold C. Sheldon, II, Hendersonville, N.C.

[73] Assignee: E. I. Du Pont de Nemours and Company, Wilmington, Del.

[21] Appl. No.: 89,024

[22] Filed: Jul. 14, 1993

Related U.S. Application Data

[62] Division of Ser. No. 809,150, Dec. 16, 1991, Pat. No. 5,295,586.

[51] Int. Cl.[5] ..... B65H 29/24

[52] U.S. Cl. ..... 271/195; 271/184; 271/197; 271/297; 271/300; 271/213

[58] Field of Search ..... 271/184, 195–198, 271/279, 287, 289, 288, 290, 297, 298, 299, 300, 213, 309, 310, 276; 414/790.7, 793.3

[56] References Cited

U.S. PATENT DOCUMENTS

| | | | |
|---|---|---|---|
| 3,659,840 | 5/1972 | Ruck | 271/197 X |
| 3,796,424 | 3/1974 | Fox | 271/197 X |
| 3,861,259 | 1/1975 | Hitch | 271/197 X |
| 4,157,177 | 6/1979 | Strecker | 271/197 |
| 4,835,947 | 6/1989 | Langen et al. | 271/195 X |

FOREIGN PATENT DOCUMENTS

| | | |
|---|---|---|
| 0057156 | 8/1982 | European Pat. Off. . |
| 0113011 | 7/1984 | European Pat. Off. . |
| 0121432 | 10/1984 | European Pat. Off. . |
| 0403901 | 12/1990 | European Pat. Off. . |
| 2820877 | 12/1978 | Fed. Rep. of Germany . |

*Primary Examiner*—Robert P. Olszewski
*Assistant Examiner*—Boris Milef
*Attorney, Agent, or Firm*—Thomas H. Magee

[57] ABSTRACT

The instant invention provides a method for reliably separating a selected sheet from a spaced array of sheets transported on a conveyor. The invention continuously maintains vacuum on the conveyors, and uses selectively activated jets directed at the underside of the sheets to divert them for separating. The invention positively controls the destination of discrete, flexible sheets, such as photographic film, by continuously engaging the sheets with another conveyor during separating, sorting, shuffling or the like, as they travel in an array along a conveyor. Positive control of the sheets permits reliable, high speed separating of lightweight, flexible sheets.

4 Claims, 7 Drawing Sheets

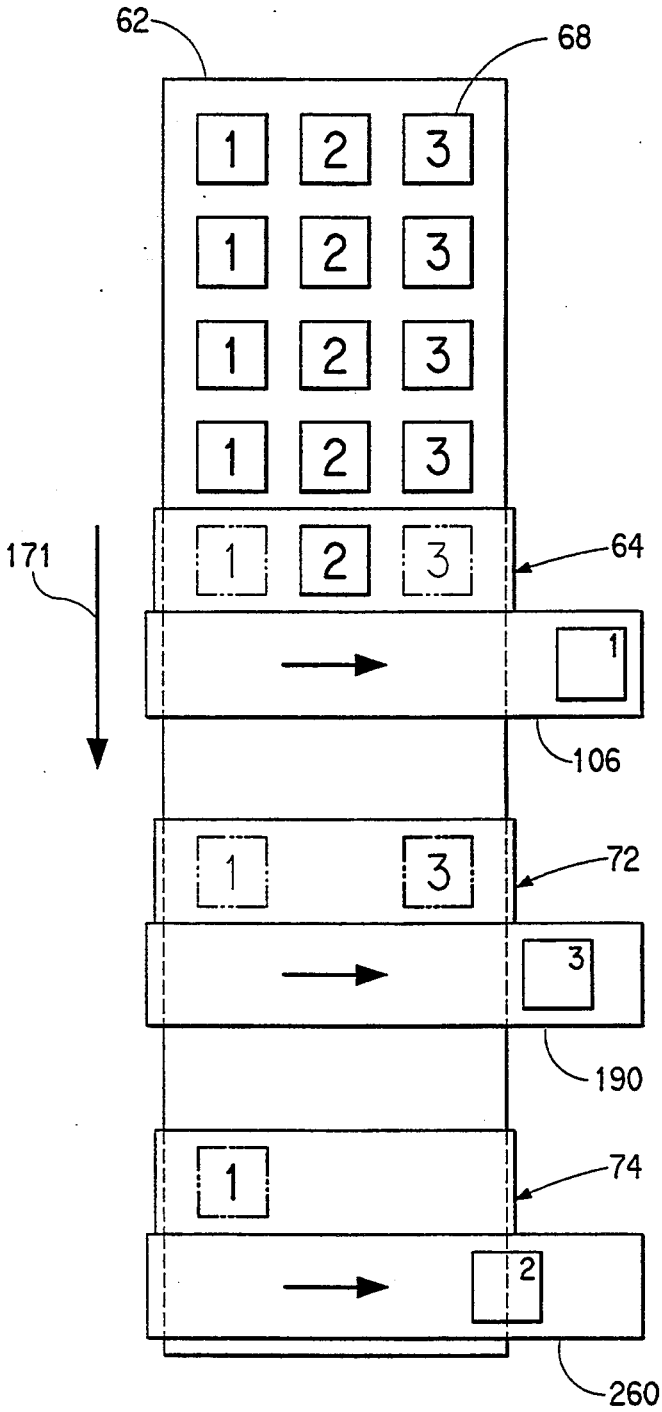
FIG.6
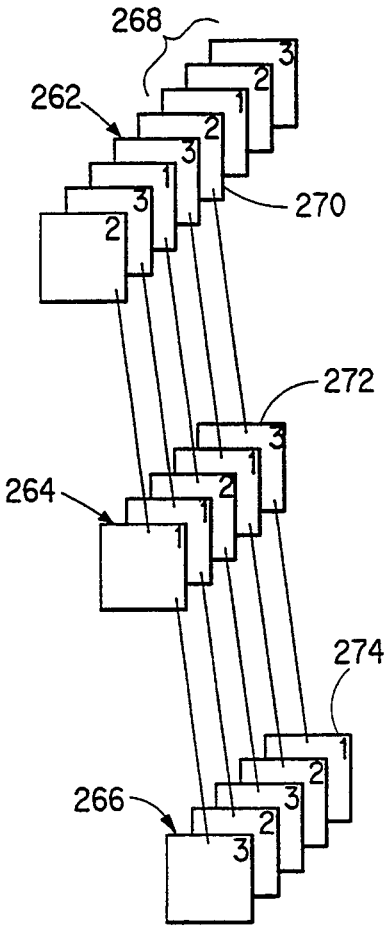

METHOD FOR SEPARATING A SHEET FROM AN ARRAY OF SHEETS CONVEYED ALONG A VACUUM CONVEYOR USING DIVERTING NOZZLES

This is a division of application Ser. No. 07/809,150, filed Dec. 16, 1991 now U.S. Pat. No. 5,295,586.

BACKGROUND OF THE INVENTION

1. Field of the Invention

This invention pertains to a method for separating a predetermined sheet from an array of sheets on a conveyor.

2. Description of Related Art

Widestock rolls of web, such as film or paper, frequently are cut into sheets suitable for use by a customer, typically by first slitting the wide rolls into narrow rolls and then chopping the film from the narrow rolls into sheets. When the slitting and chopping steps are performed on a widestock roll substantially simultaneously, an array of sheets having transverse rows and longitudinal lanes is transported on a conveyor to a station which stacks the individual sheets for packaging. Typically, in the case where the web is coated, the array of sheets is inspected for defects which occurred during the coating or finishing operation, and defective sheets are separated therefrom. In addition, sheets from the array may be separated for sampling purposes. Furthermore, there may be a desire to randomly combine or shuffle equally sized sheets from different lanes into stacks of sheets which are selected from a variety of different parts of the web. A problem arises when one sheet in the array has a defect or needs to be separated from the array for any purpose. In the past, the entire transverse row or crosscut of sheets containing the defective sheet would be separated. This separating of additional sheets results in much reworking of the separated sheets and possible waste of acceptable, i.e., defect-free, material.

One method which is particularly adapted to handling articles of this nature is to transport the array of sheets by means of a conveyor comprising an endless, perforated belt which moves by means of drive rolls and idler rolls. Typically, such a conveyor includes a vacuum box having an apertured portion about which the perforated belt moves. By this means, the array of sheets that have been positioned on the conveyor will be securely transported by the vacuum from the slitting and chopping location to the stacking location. If the sheets are flexible, limber, or relatively lightweight, such as photographic film sheets, there is a problem when diverting sheets from one vacuum conveyor to another for separating, shuffling, stacking, or special handling, in that a lightweight sheet is easily displaced by air currents, so accurate location of the sheet is difficult to maintain and sheet damage is possible. This is particularly true when the sheet is transported at high speed. There is a need to reliably transfer a single lightweight sheet in an array of sheets from one conveyor to another while continuously retaining positive accurate control of the single sheet and the remainder of the array of sheets.

U.S. Pat. No. 3,500,999 issued to Lippke discloses a sorting and separating system for sheets of material, such as paper or cardboard, that are being transported in transverse rows and longitudinal lanes. The sheets are chopped from a continuous web and are placed on the top of a first air-permeable conveyor below which is a box in communication with a source of suction. In an embodiment shown in FIG. 10 of this patent, good sheets continue to the end of the first conveyor for stacking. Sheets to be separated, such as rejects identified by a checker, are transferred to a second conveyor spaced closely above the first conveyor. Suction to the first and second conveyor boxes can be selectively turned off and on to transfer the sheets upward to the second conveyor, or the sheets can continue along the first conveyor. Sheets can be selectively deposited by the second conveyor into one or more stacks. In another embodiment, the boxes of the conveyors can be alternately subjected to over or under pressure to deposit the sheets. The permeable conveyor belts comprise a screen cloth with metal members for draining off static charge for better sheet handling.

U.S. Pat. No. 3,608,895 issued to Kalven discloses a shuffling and packaging system for flat products, particularly floor tiles. The tiles leave a production conveyor in transverse rows and longitudinal lanes, and are transported by a plurality of conveyors so as to mix the tiles from different lanes for subsequent packaging. The tiles are transported from the production conveyor to an accelerator conveyor. A vacuum conveyor, associated with each lane of tiles, lifts the tiles from the accelerator conveyor and carries the tiles over transverse conveyors. The tiles are selectively deposited onto the transverse conveyors by the operation of unique pressure valves which act to positively break the vacuum supporting the tiles over selected transverse conveyors. The tiles are fully released from the vacuum conveyor so as to drop from the vacuum conveyor to the transverse conveyor from which they are counted and stacked.

SUMMARY OF THE INVENTION

The present invention comprises a method for reliably separating a selected sheet from a spaced array of sheets substantially aligned on a conveyor. The apparatus used in the present method comprises:

- a first conveyor having a plurality of spaced belts moveable from an entrance end to an exit end of said first conveyor, each of said belts having perforations in a top surface thereof in fluid communication with a vacuum source for retaining said sheets, said belts positioned with spaces therebetween such that at least two belts are adapted to support each sheet;
- a controller for determining when a sheet from the array is to be separated therefrom based upon preselected criteria;
- a plurality of diverters aligned transversely to said first conveyor and positioned in the spaces between said belts, said diverters connected to said controller so as to be individually responsive to said controller for diverting the selected sheet away from the top surface of said belts in a direction that separates the selected sheet from the array; and
- a second conveyor having a belt moveable from an entrance end to an exit end thereof, said entrance end spaced near the first conveyor and adjacent the aligned diverters, the belt of said second conveyor having perforations in a bottom surface thereof in fluid communication with a vacuum source for retaining said selected sheet, said bottom surface facing the first conveyor so as to receive the selected sheet, when diverted away from said first conveyor, and transport said selected sheet away from said first conveyor to the exit end of said second conveyor.

There is also also provided a method for diverting a single flexible sheet from a row of sheets as they are transported on one conveyor past a diverting conveyor, by peeling the leading edge of the sheet off the one conveyor and engaging it by the diverting conveyor while continuing to engage the trailing end of the sheet by the one conveyor.

Further, there is provided a method for sorting and stacking lanes of transported sheets into equal-count stacks, comprising the steps of:

a) selecting and diverting selected sheets from one of a plurality of lanes of sheets;
b) stacking the remaining sheets from each of the one and the other lanes into stacks;
c) counting the sheets in each stack;
d) selecting and diverting the sheets from the other lanes when the count of sheets in each of the stacks for the other lanes reaches a designated number;
e) stopping the stacking when the count of remaining sheets from the one lane reaches the designated number.

BRIEF DESCRIPTION OF THE DRAWINGS

FIG. 6 is a diagrammatic view of the present apparatus adapted to stack sheets from different lanes into a single stack.

DETAILED DESCRIPTION OF THE PREFERRED EMBODIMENTS

Figure 1:
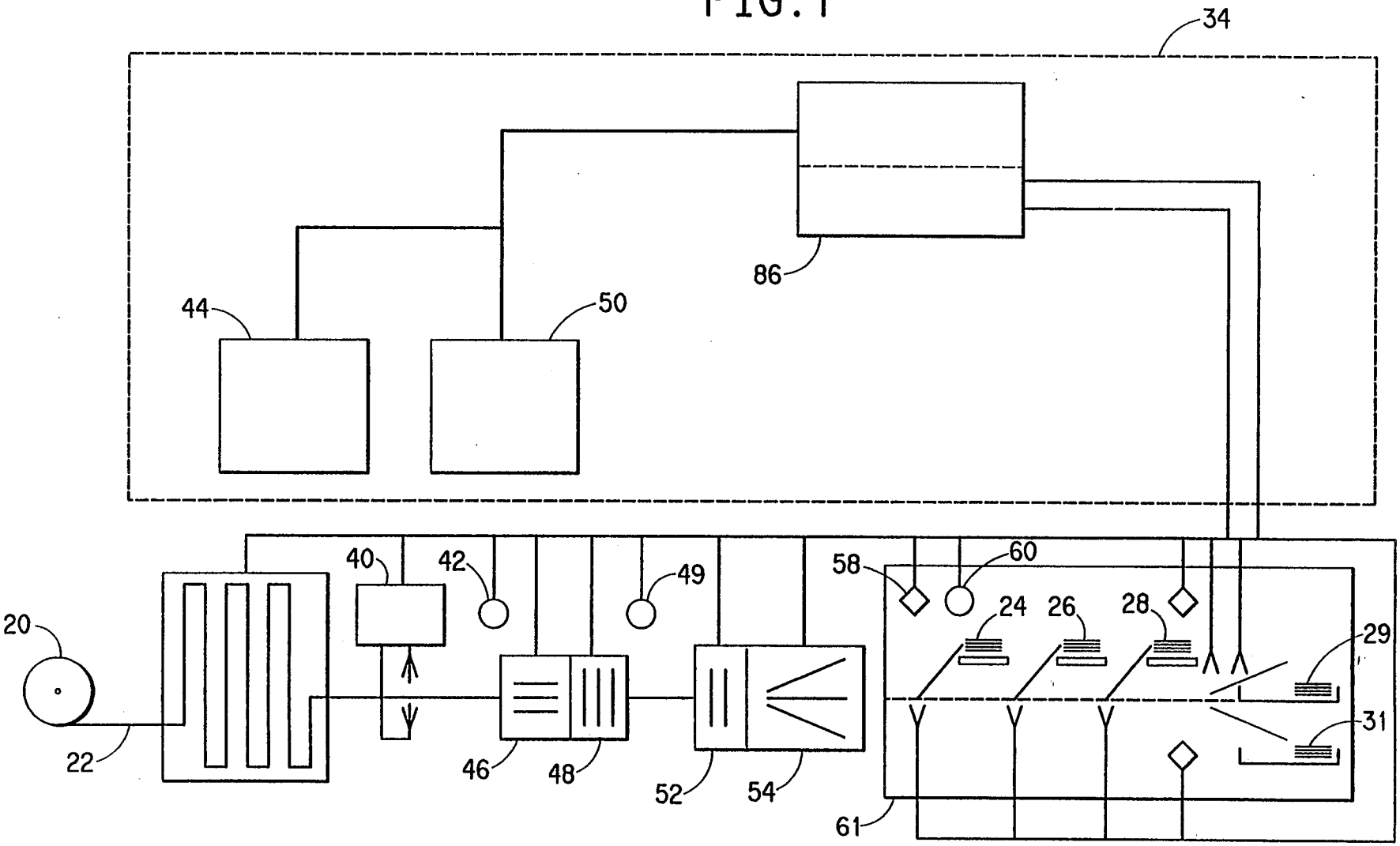
FIG. 1 is a schematic view of a process for unwinding a widestock roll of webbed material to form stacks of cut sheets, including a control system.

FIG. 1 shows a process for unwinding a roll 20 of material or web 22 to form stacks of cut sheets, such as stacks 24, 26, 28, 29 and 31. The process is implemented by a control system 34. The roll 20 of material is unwound and is inspected by a suitable inspection unit 40 for any defect in the material and/or coating thereon. A suitable inspection unit for photosensitive materials or films is commercially available from ERWIN SICK GMBH, Munich, Germany, model SC1600 Surface Inspection System. The location of a defect on the web, identified by the inspection unit 40, is tracked with the aid of a rotary encoder or a motion pulse generator 42 in conjunction with inspection data output by the inspection unit 40. The defect location on the web 22 has coordinate data associated with it determined by the unwinding or machine direction of the web and by a direction transverse to the machine direction, i.e., cross-web direction. This data is sent to an inspection computer 44. The web is slit by a slitter 46 in the machine direction into one or more lanes of desirable widths. All the lanes are chopped by a chopper 48 to the same length in the cross-web direction, i.e., transverse rows, to form individual sheets. A chop pulse generator 49 detects the completion of the chop blade motion so that this event can be coordinated with the inspection data by the computer 44 to define which sheets have rejects located therein. The slitting and chopping operations are controlled by a distributed slit-chop computer 50. The individual sheets are sent through a sheet spacer 52 which spaces the individual sheets of material apart on a conveyor in the machine direction, and through a sheet spreader 54 that spreads the sheets apart laterally on a conveyor in the cross-web direction. The operation of the space and spread conveyors is mechanically controlled and is usually adjusted only at start-up with no further control interaction required. Control system 34 also includes a stacker control system 86 which is in communication with the computers 44 and 50.

The space and spread operation creates a spaced array of individual sheets which is identified by initial lane information and chop information with a correction for location in the machine direction from an array of sensors 58 looking at passing rows of sheets in the array of sheets after the space and spread operation. Although there is an array of sensors 58 for determining the machine direction locations of each individual sheet, typically only the first one of the sensors detecting an edge of a sheet is used to identify the machine direction location of an entire row of sheets. This information is coordinated with a second motion pulse generator 60 for further machine direction tracking of the sheets in a sheet separating and stacking device 61, of which the sensors 58 and generator 60 are a part. The information from the remaining "non-first" sensors 58 of the array can be used to detect variability in the spacing of the sheets in the machine direction. A further description of the method and apparatus for separating individual discrete sheets to one of a plurality of destinations by device 61 will be made referring to FIGS. 2 through 5.

Figure 2:
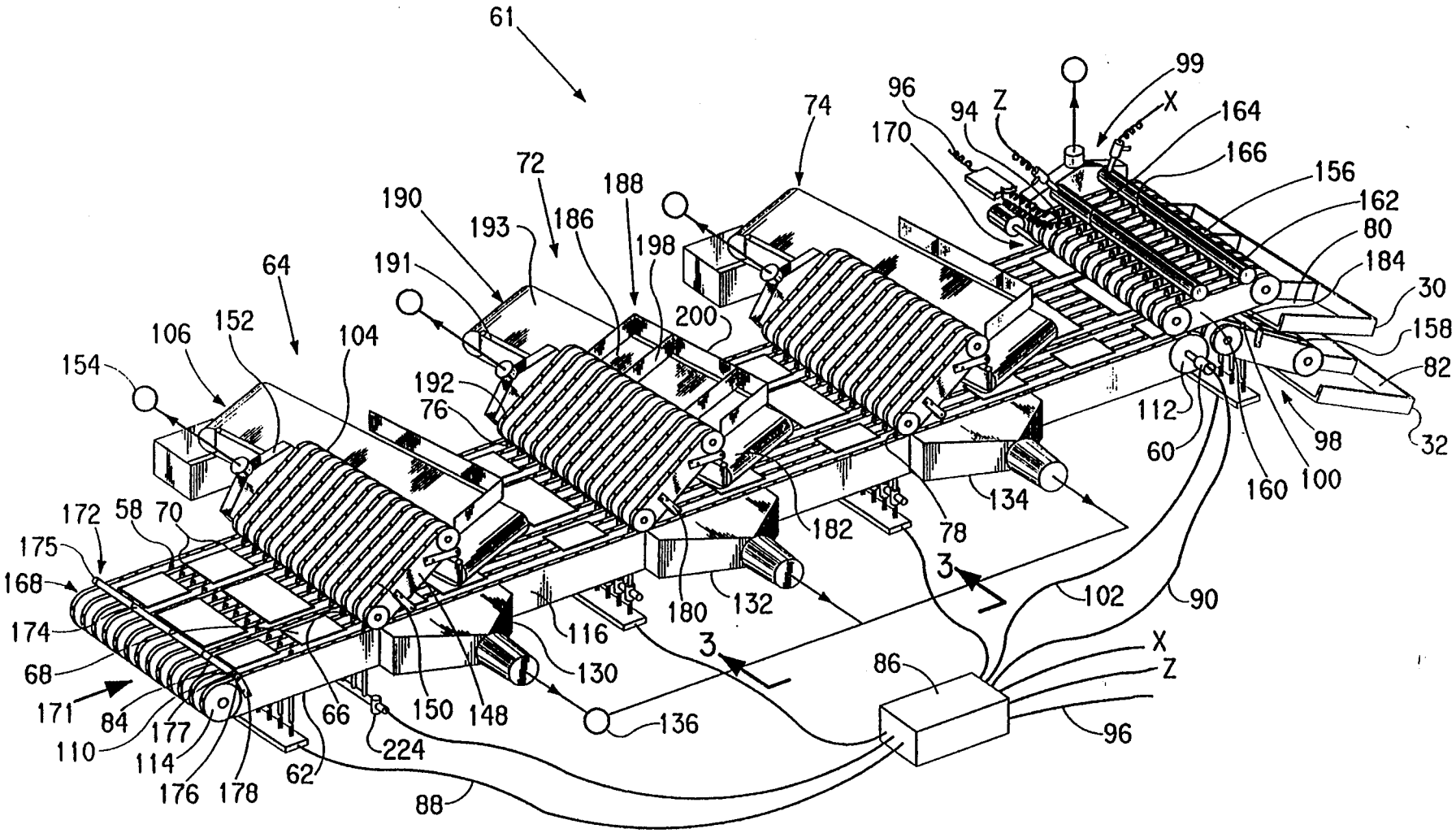
FIG. 2 is a diagrammatic perspective view of an apparatus for separating a sheet from an array of sheets, including a main conveyor, three separating assemblies, and two sheet stacking stations.

FIG. 2 shows the sheet separating and stacking device 61 which includes a main conveyor 62, at least one separating assembly 64 and at least one array of separating nozzles 66 by which a sheet 68 or a row of sheets 70 is separated, according to various predetermined guidelines, from the array of sheets on the main conveyor 62. The apparatus of this invention can individually separate any sheet from any lane of the array of sheets using the separating nozzles 66 to direct the separated sheet onto the separating assembly 64. In the preferred embodiment, there are three separating assemblies 64, 72 and 74, each assembly having an array of separating nozzles 66, 76 and 78 which are associated with the main conveyor 62. Each of the three separating assemblies separates a sheet or sheets from the array of sheets according to one of a plurality of predetermined guidelines. Predetermined guidelines for separating sheets from an array of sheets include: sampling of the sheets for off-line testing and evaluation purposes; rejecting sheets with defects as identified by the inspection unit 40; and collecting sheets which are neither part of the sampling plan nor defective, i.e., good sheets which are not allowed to proceed onto the main conveyor to a stacking location at the end of the main conveyor. The stacking location at the end of the main conveyor stacks non-separated, good sheets by lanes into either an upper tray 30 or a lower tray 32. Each tray 30 or 32 comprises a plurality of bins, such as 80 or 82, with one bin in each tray for each lane of sheets, such as lane 84 which would be stacked alternatively in bin 80 of tray 30 or in bin 82 of tray 32.

The stacker control system 86 provides overall control of the complete line and local control of the sheet separating and stacking device 61. The control system 86 receives input from the sensors 58 along a signal line 88 and from the second motion pulse generator 60 along a signal line 90. Associated with the upper tray 30 is an upper stacking assembly 99 and an array of sensors 94 for monitoring the array of sheets for unexpected events. The sensors 94 input information to the control system 86 along a signal line 96. Associated with the lower tray 32 is a lower stacking assembly 98 and an array of sensors 100 for monitoring the array of sheets for unexpected events. The sensors 100 input information to the control system 86 along a signal line 102. The sensors may be retroreflective sensors, capacitive proximity sensors, fluidic sensors, touch sensors, or the like.

The separating assemblies 64, 72 and 74 each include an up-angled separating conveyor, such as separating conveyor 104, and a cross conveyor assembly, such as cross conveyor assembly 106. The upper and lower stacking assemblies 98 and 99 include upper and lower stacking conveyors 158 and 156, respectively. The main conveyor 62, the up-angled conveyors of each separating assembly, such as the separating conveyor 104, and the upper and lower stacking conveyors, such as the stacking conveyor 156, all have many features in common. The main conveyor 62 will be discussed as representative of the above-mentioned conveyors. The main conveyor 62 includes a plurality of endless perforated belts, such as belt 110, which move by means of a drive roller 112 and an idler roller 114. The drive roller 112 includes a plurality of projections on its periphery that engage the perforations on each of the plurality of belts so that positive no-slip driving engagement of all belts is assured. The plurality of endless belts are spaced apart in the transverse, cross-web direction.

Figure 4:
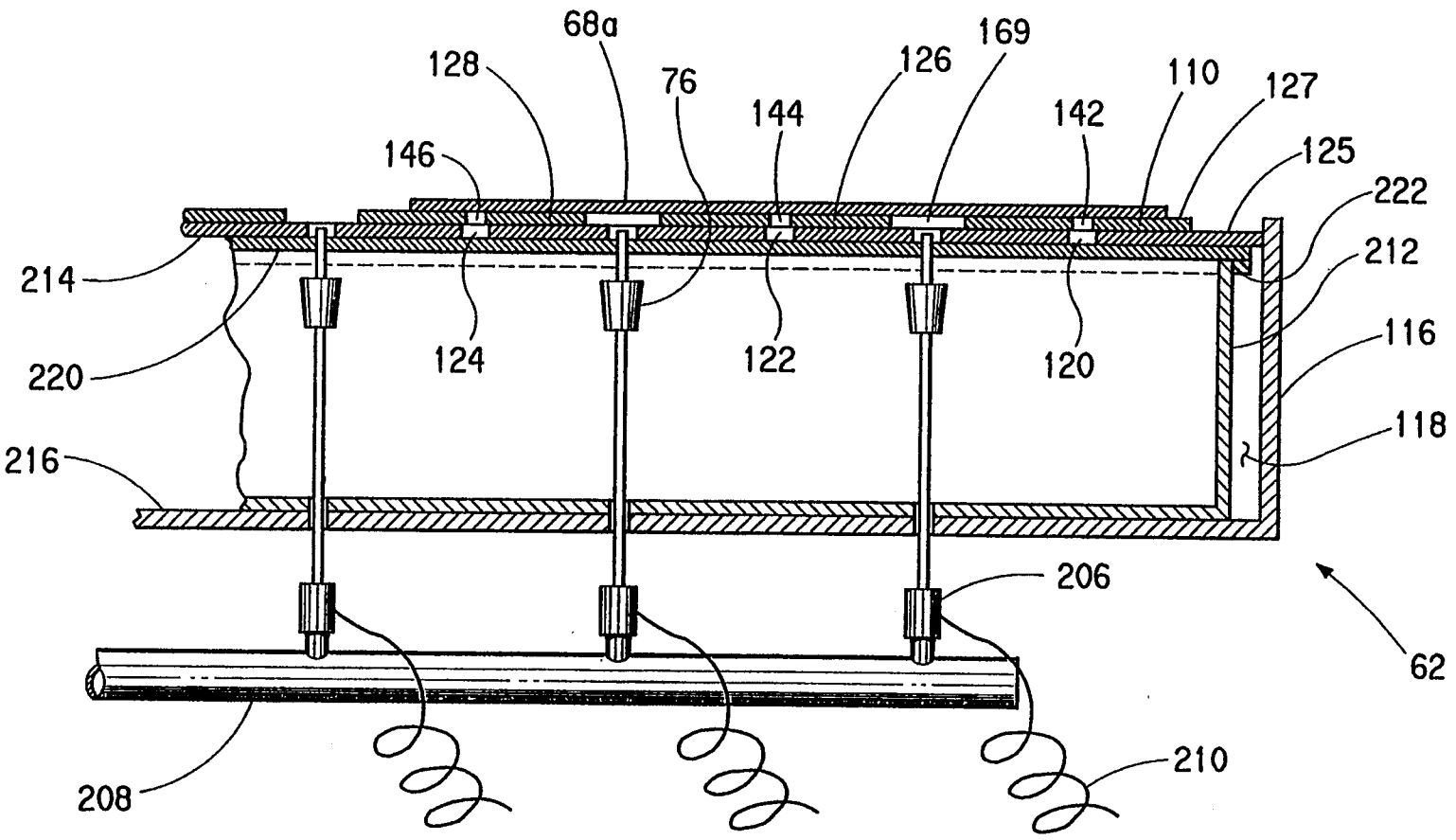
FIG. 4 is a partial cross-sectional view of an array of separating nozzles taken along line 4—4 of FIG. 3.

FIG. 4 shows the main conveyor 62 which includes a vacuum box 116 having a chamber 118 with apertured portions 120, 122 and 124 about which the plurality of endless belts move. The apertured portions 120, 122 and 124 in the upper surface of the vacuum chamber 118 form a support surface 125 for the endless belts 110, 126 and 128. The vacuum box 116 has one or more vacuum ducts 130, 132 and 134 connected to vacuum blowers, or preferably a single vacuum blower 136 (shown in FIG. 2). The apertured portions 120, 122 and 124 of the main conveyor 62 are in fluid communication with a top surface of run 127 of the belts 110, 126 and 128 through a plurality of belt holes 142, 144 and 146, respectively. This establishes a vacuum along the top surface or run 127 of the conveyor 62 so that the sheet 68 of flexible material can be held by vacuum against the belts 110, 126 and 128, and transported in a controlled fashion.

Similarly, the up-angled separating conveyor 104 includes a vacuum box 148 about which a plurality of endless belts, such as 150, move. Apertured portions on the separating conveyor 104 establish a vacuum along a bottom surface or run of the conveyor 104 via holes in the belts 150 so that sheets of flexible material are transferred to the separating conveyor 104 from the main conveyor 62 and transported in a controlled fashion. The vacuum box 148 associated with the separating conveyor 104 has one or more ducts 152 connected to a vacuum blower 154. Similarly, each of the upper and lower stacking conveyors 156 and 158 includes a vacuum box, such as 160 for the conveyor 156, about which a plurality of endless belts, such as 162, move. The upper stacking conveyor 156 has a vacuum established along a bottom surface or run of the conveyor 156, and the lower stacking conveyor 158 has a vacuum established along the top surface or run of the conveyor 158.

The upper stacking conveyor 156 is positioned to overlap an exit end 170 of the main conveyor 62, and the bottom surface of the upper stacking conveyor 156 is spaced closely from the top surface of the main conveyor 62. In operation, as the leading edge of all good sheets reach the exit end 170 of the main conveyor 62, they are no longer engaged by the main conveyor vacuum. At this point, the leading edge of a sheet is engaged by the vacuum of the closely spaced upper stacking conveyor 156, which is traveling at the same speed and direction as the main conveyor 62. The sheet is progressively peeled off the main conveyor 62 until it is fully engaged by the upper stacking conveyor 156. The sheet, or rather row of sheets, now must either continue to advance on the upper stacking conveyor 156 and be diverted into the upper stacking tray 30, or be diverted to the lower stacking conveyor 158. The upper stacking conveyor 156 has an array of diverting nozzles 164 to divert sheets to the lower stacking conveyor 158 or, if the sheets continue along the upper stacking conveyor 156, an array of diverting nozzles 166 to divert sheets to the upper stacking tray 30. Sheets diverted to the lower stacking conveyor 158 continue to the end of the conveyor 158 where the vacuum is terminated and the sheets are released so as to fall into the bins, such as bin 82 in lower tray 32. Nozzles 164 and 166 are shown outside and passing through the assembly of the upper stacking conveyor 156 for illustration clarity; in practice, they can be located inside the assembly of the conveyor 156 and directed at the sheets on the bottom surface of the conveyor 156. Although belt conveyors with vacuum boxes are shown for conveying the sheets, other conveying means that positively hold the sheets are possible, such as electrostatic conveyors, mechanical gripper or suction cup conveyances, or rotary tables or drums using vacuum, electrostatics, or mechanical grippers to hold the sheets.

The main conveyor 62 has an entrance end 168 and an exit end 170. The sensors 58 are positioned near the entrance end 168 of the main conveyor in spaces between the perforated belts 110, 126 and 128, such as spaces 169 shown in FIG. 4 where the nozzles 76 are located. The sensors 58 detect the leading edge of the row of sheets advancing in the direction of arrow 171 from the space and spread conveyors to the main conveyor 62. The edge sensors 58, in conjunction with a motion pulse generator 60, provide an accurate reference position for the sheets so the leading edge can be tracked along the main conveyor and be selectively separated at the appropriate position by one or more diverting nozzles to the separating assemblies.

It is preferred that the entrance end 168 of the main conveyor 62 have an air dam 172 to prevent stray air currents from disturbing the leading edge of the sheets as the sheets are engaged by the main conveyor vacuum from the space and spread conveyor. Stray air currents on the main conveyor 62 can occur from the array of separating nozzles 66 near where the sheets are transferred to the first separating assembly 64. The air dam 172 is placed transverse to the direction of the main conveyor, and includes a plurality of rollers 174, which are mounted on a single shaft 176. The rollers 174 are of the type used for applying paint to surfaces and can be obtained commercially. Each roller 174 has a thick, compliant, nap covering of about 0.25 inches, which compresses about 0.12 inches when in contact with a sheet on the upper conveyor surface. The rollers 174 are rigidly attached to the shaft 176. Each end of the shaft 176 is mounted in rotary bearings attached to a bracket 178. At the end of the shaft 176 adjacent the rollers 174 are wheels 175 and 177, having a diameter slightly smaller than the uncompressed diameter of the rollers 174, which contact the surface of the outermost belt on each side of the conveyor 62. Contact of the wheels 175 and 177 with the belt surfaces positions the air dam 172 relative to the upper conveyor surface and positively drives the rollers 174 at a speed approximating the belt speed. Thus, the rollers 174 are driven in unison with the belts 110, 126 and 128. The brackets 178 are mounted to the outer surface of the vacuum box 116 of the main conveyor 62, and may include pivots and springs for resiliently pressing the rollers 174 and wheels 175 and 177 against the belt surfaces, and the rollers 174 against any sheets therebetween. The air dam 172 is effective in holding the sheets in place against the main conveyor 62 with a controlled minimum force without producing any damaging surface contact marks or creating static charge on the sheets. The air dam 172 also holds the sheets against the surface of the main conveyor belts, such as the belt 110. It is preferred to include two such air dams with each up-angled conveyor for the separating assemblies, such as dams 180 and 182 in FIGS. 2 and 3, and an air dam 184 for the lower stacking conveyor 158. Similarly, these air dams block stray air currents and hold the sheets against the belts, especially air dam 182 that holds the trailing edge of sheets being separated from the up-angled conveyor belts. Rollers with a nap have been described as preferred for holding the sheets and blocking stray air currents, but other means acting as rollers in this application are possible, such as rollers without a nap.

The main conveyor 62 has three arrays of diverting nozzles 66,76 and 78 in the spaces between the perforated belts providing vacuum at the top surface. The three arrays are associated with the up-angled conveyors of the separating assemblies to selectively separate sheets onto the up-angled conveyors. The sorting order illustrated is "samples" for the assembly 64, "uncounted good sheets" for the assembly 72 and "reject" for the assembly 74. This is not critical and can be varied. For instance, another preferred order is "reject", "uncounted good sheets" and "samples". Sampling of the array of sheets is typically accomplished on a schedule which has been programmed into the system computer according to the requirements of the particular web being run. Preferably, the sample sheets are separated as a row onto the "sample" separating assembly 64.

Designating defective sheets from the array of sheets and separating them onto the separating assembly for rejected sheets is accomplished with the data from the inspection computer 44 and the slit-chop computer 50. The control system 34, which includes the stacker control system 86, combines the defect information and location information to determine which sheets from the array of sheets are to be separated from the flow of good sheets on the main conveyor. The defective sheets are separated onto the "reject" separating assembly 74.

Designating good sheets which can not proceed on the main conveyor 62 to a "good sheet" stacking location occurs when the number of sheets in a "good sheet" bin in a stacking tray has reached a predetermined limit, e.g., 100 sheets in the bin. Since the sampling plan and the number of defective sheets for any lane may vary, the stacking tray for each lane may not fill at the same time. This information is known when the sheet reaches the entrance end 168 of the main conveyor 62. Each lane of good sheets continues on the main conveyor 62 and is stacked into a stacking bin until one of the lanes has a full bin. The good sheets in the one lane with the full bin are then separated from the array of sheets onto the "uncounted good sheet" separating assembly 72 where they end up in a slot, such as the slot 186, defined by a divider assembly 188 attached to a cross conveyor assembly 190. When another lane of sheets has a full tray, sheets from this lane are also separated onto the "uncounted good sheet" separating assembly 72. Each lane of sheets is separated to the "uncounted good sheet" separating assembly when the stacking bin for the lane is full, until all lanes have reached the sheet limit in the stacking bins, for example, the bins 80 of tray 30 associated with the upper stacking assembly 99. Then, the separation of the good sheets to the "uncounted good sheet" separating assembly is stopped and all lanes on the main conveyor begin to fill the bins 82 for stacking tray 32 associated with the lower stacking assembly 98. The process repeats for separating good sheets by lanes to the "uncounted good sheet" separating assembly when the stacking bin for a lane is full. Sheets on the "uncounted good sheet" cross conveyor assembly 190 are periodically removed from the "uncounted good sheet" assembly and handled manually. This process is an improvement over a previous process of rejecting all sheets in a row whenever one sheet in a row was a reject. The new process results in fewer sheets being separated and good sheets not being combined with rejects.

Figure 3:
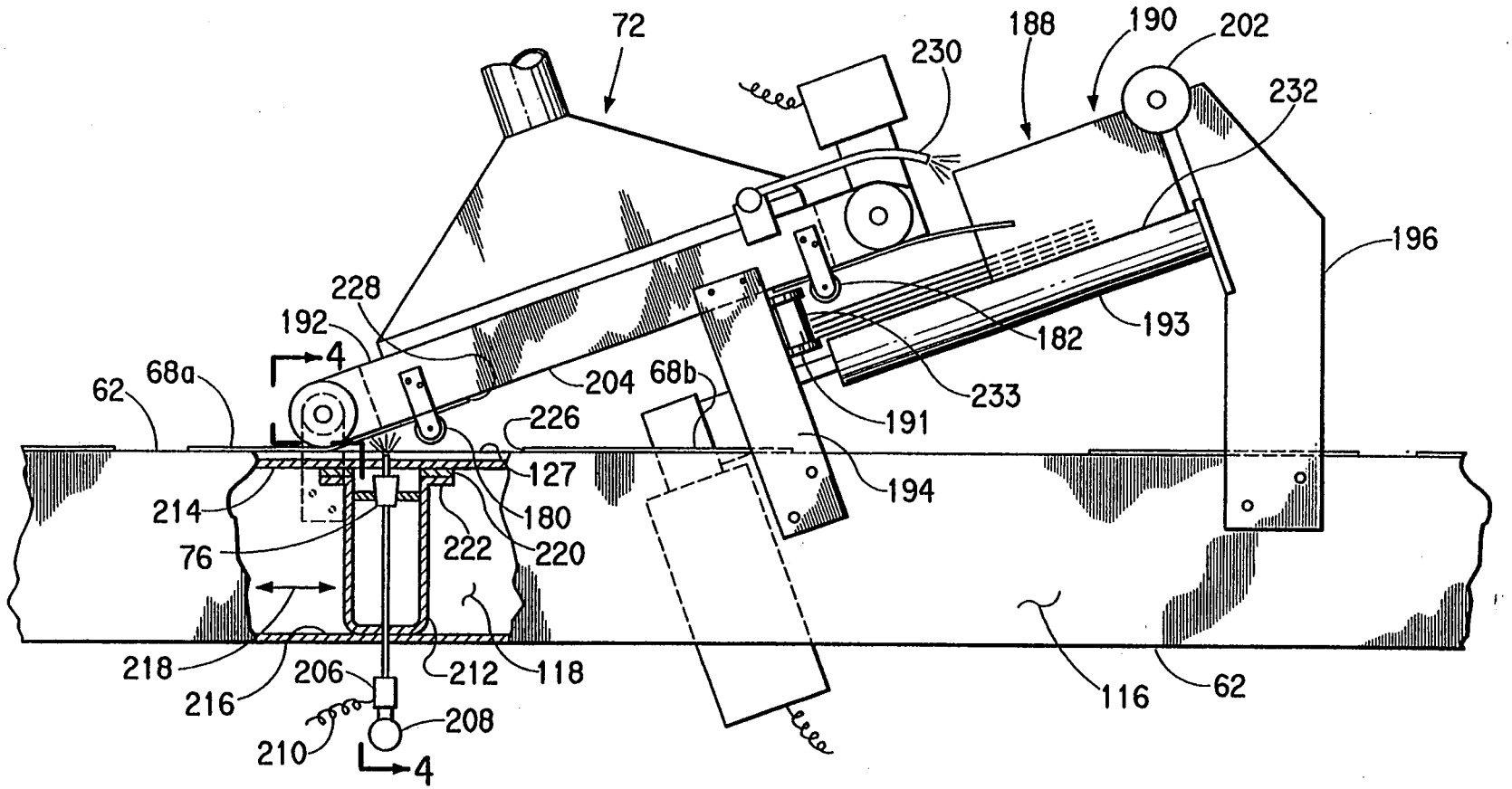
FIG. 3 is a partially cutaway elevational view of a separating assembly, including separating nozzles, taken along line 3—3 of FIG. 2.

FIG. 3 shows a typical separating assembly, such as the assembly 72, which includes an up-angled conveyor 192, cross conveyor assembly 190, and a plurality of associated diverting nozzles 76 on the main conveyor 62. The up-angled separating conveyor 192 follows a diverging path away from main conveyor 62. Such a diverging path, however, is in the same general direction as the path of the belts 110 on the conveyor 62, so the change of direction for a sheet is gradual. The conveyor 192 is supported at the upward position by a bracket 194 mounted to the vacuum box 116, which also serves as a frame for the main conveyor. A second bracket 196 mounted to the frame, or box 116, of the main conveyor 62 also supports the cross conveyor assembly 190, which transports the separated sheets to a location on the side of the main conveyor 62. The cross conveyor assembly 190 includes a pair of conventional single belt conveyors, such as the conveyors 191 and 193, positioned with their belt surfaces at 90 degrees to each other to define a sheet surface 232 and an edge surface 233. The assembly 190 may further include a moveable divider 188 to define slots 186, so as to align the separated sheets into stacks for ease in handling by the operators. The divider 188 has panels 198 (see FIG. 2) slideably mounted to a crossplate 200, so that the position of the panels 198 can be adjusted according to the width of the lane. The divider 188 is located at the cross conveyor assembly 190 to keep the sheets from adjacent lanes from mingling together. Mounted to a side of the crossplate 200 is a rotary actuator 202 connected to the second bracket 196. The rotary actuator 202 pivotally lifts the divider 188 so that the separated stacks of sheets can be transported unrestricted by the conveyors 191 and 193 to the side of the main conveyor 62 for manual removal. As previously discussed, the separating assemblies also include an air dam 180, near the entrance end of the up-angled conveyor 192, and an air dam 182 near the exit end of the up-angled conveyor 192.

FIGS. 3 and 4 show the array of separating nozzles 76 in relation to the separating assembly 72 in more detail. The nozzles 76 blow air at a high flow rate, i.e., a jet of air, to direct the sheet 68*a* from the top vacuum surface 127 of the main conveyor 62 to a bottom vacuum surface 204 of the up-angled separating conveyor 192, and thus separate the sheet 68*a* from the array of sheets. The air nozzles suitable for use in this invention are manufactured by Vortex Corp. of Cincinnati, Ohio, model "Mighty-Mite" with about a 0.25 inch (6.4 mm) jet opening. Each nozzle of the array of nozzles has a valve 206 by which the nozzle is turned on and off. All the valves associated with an array of separating nozzles are connected to a source of pressurized air via a port or manifold 208. The valves are individually controlled by signals along lines, such as the line 210, from the stacker control system 86. The array of nozzles 76 are mounted in a trough 212 that fits between an upper inside surface 214 and a lower inside surface 216 of the vacuum chamber 118 of the main conveyor 62. The trough 212 is adjustable for about 2 inches along the length of the main conveyor 62, as shown by the arrows 218, to allow fine tuning of the position of the array of separating nozzles 76 relative to the up-angled separating conveyors so that the leading edge of the sheet can be reliably separated and peeled off the main conveyor 62. The trough 212 also blocks the effects of the vacuum surrounding each nozzle to make it easier for the jet of air from the separating nozzle 76 to lift and to engage the leading edge of a sheet with the separating conveyor vacuum. A seal 220 is located between an upper flange 222 of the trough and the upper surface 214 of the vacuum chamber to limit the vacuum effects at the nozzle 76. The apertured portions 120, 122 and 124 in the vacuum box 116 (see FIG. 4) allow a small amount of vacuum to be present in the trough 212 so that the stability of the sheets crossing the trough 212 is assured. Other means of diverting sheets are possible, such as electrostatic diverters, mechanical fingers, liquid streams or the like depending on the characteristics of the sheets being diverted.

In FIG. 2, the sample separating conveyor 64 is shown near the entrance end 168 of the main conveyor 62. The plurality of separating nozzles 66 to separate the sample sheets are all manifolded to an air valve 224 and air source since the nozzles 66 are typically all actuated at the same time to divert a complete cross row of sample sheets whenever samples are required by the programmed sampling plan. To ensure uniformity of distribution of air to the nozzles 66, it is preferred that there be four such valves 224 acting together; one at each end and two distributed about the middle of the array of nozzles 66. In this embodiment, it is preferred that an entire cross-web array of sheets be sampled. If a single lane of sheets was desired for samples, each nozzle 66 would have its own individual valve, similar to the other two separating conveyors.

FIG. 3 shows the separating of a sheet to an up-angled conveyor 192. After the trailing edge 226 of a preceding sheet 68*b* passes the nozzles 76 and the leading edge 228 of an approaching sheet 68*a* to be separated reaches the nozzles 76 in the lane containing the sheet 68*a*, the control system 86 energizes the valves 206 for those nozzles 76. This causes air flow through the nozzles 76 to strip the leading edge 228 of the sheet 68*a* in that lane from the main conveyor vacuum and divert the sheet to the up-angled separating conveyor 192 where the sheet 68*a* becomes engaged by the vacuum on the lower surface 204 of the separating conveyor 192. The diverting nozzles 76 are activated such that the jet of air begins to flow after the trailing edge of the previous row passes by the nozzles 76 and before the leading edge of the desired row of sheets is at the nozzles 76. The time at which the valves 206 are activated may need to be adjusted relative to the speed of the main conveyor 62 to accommodate any delay between when the signal is sent by the control system 86 and when the air flows from the separating nozzles 76. The nozzles 76 remain on long enough to completely strip the sheet 68*a* off the main conveyor 62. The vacuums on the main and separating conveyors remain on continuously as the sheet 68*a* is peeled from the main conveyor 62 and engaged by the separating conveyor 192. Alternatively, dissipating the vacuum in box 118 and restoring it either by switching the vacuum off and on or switching pressure to the box 118 off and on is slow and difficult to control precisely. By maintaining the vacuums in the conveyor boxes on continuously and turning selected nozzles on and off to divert sheets provides a more rapid, precise control of separating sheets. The sheet 68*a* is carried up to the end of the separating conveyor 192 where the vacuum box ends and the leading edge 228 of the sheet 68*a* is directed down by a plurality of diverting nozzles 230, and the trailing edge of the sheet 68*a* is supported by an air dam 182. The action of the diverting nozzles 230 ensures the separated sheet 68*a* is properly placed onto the surface 232 of the cross conveyor 193. The diverting nozzles 230 have been omitted from FIG. 2 for clarity.

Figure 5B:
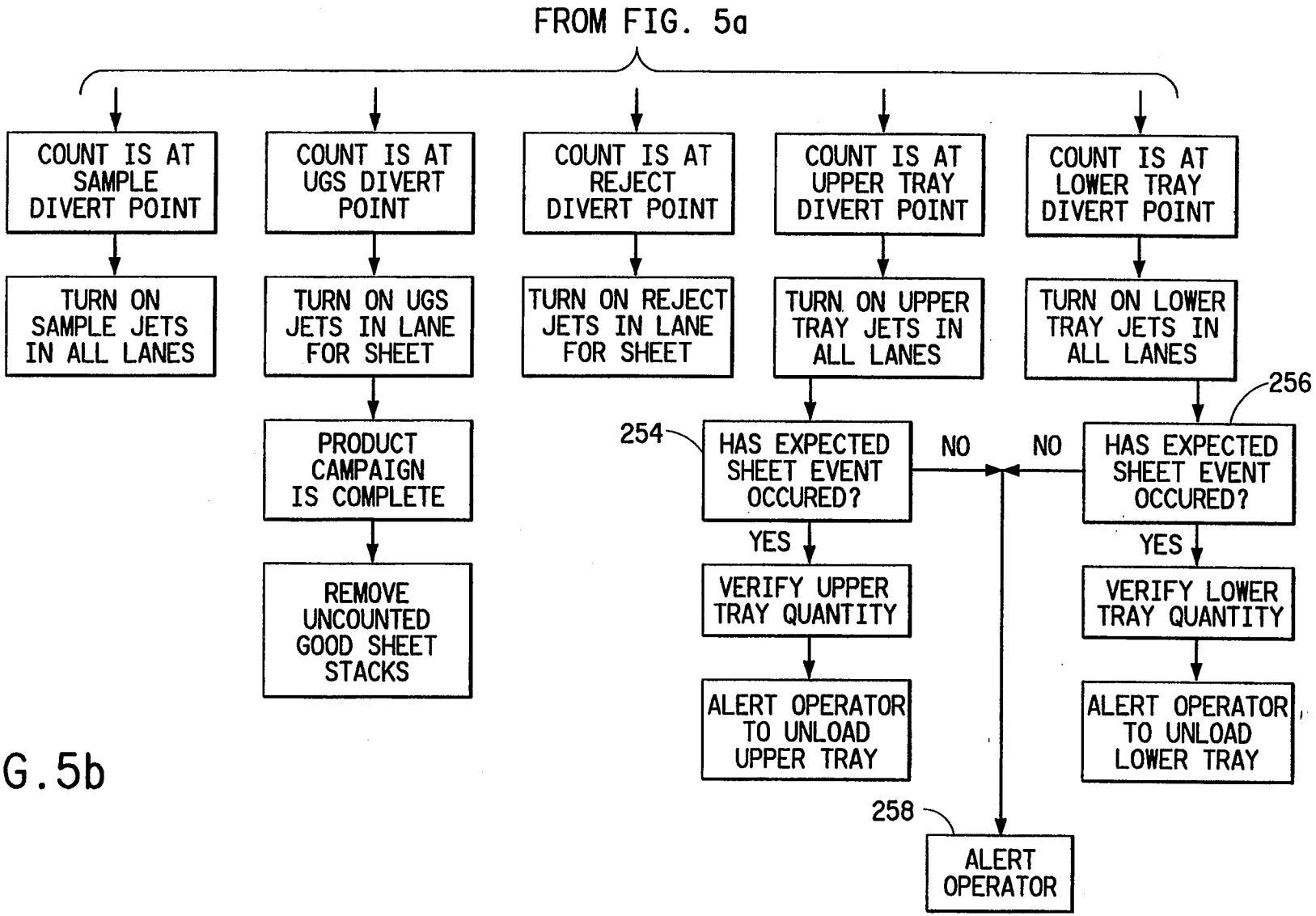
FIGS. 5*a* and 5*b* are a flow diagram of the method in which a sheet is separated from an array of sheets.
Figure 5A:
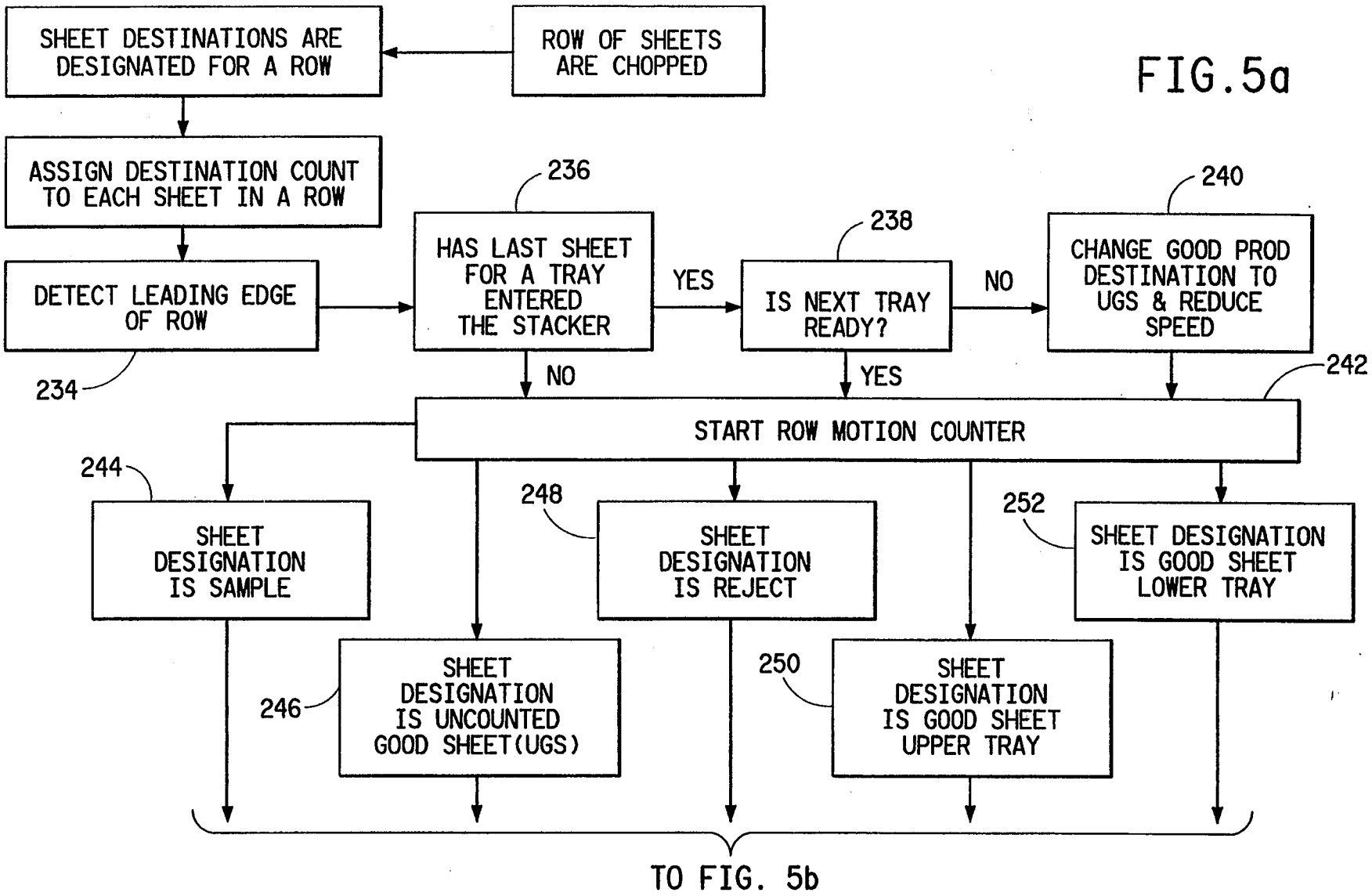

FIGS. 5*a* and 5*b* show a flow diagram that illustrates the control and operation of the stacking device 61. The inspection information regarding the coordinates in the continuous web where there are rejectable defects is combined with the transverse location of the slits and the linear location of the chops that create the rows of discrete sheets of film. This combining of information is completed when the slit lanes of film are chopped, and the event is signaled when the chop pulse generator 49 on the chopper 48 provides the pulse that indicates chopping occurred. At this moment, the destination of each sheet can be predetermined. Other information that is considered in making this determination is the need for samples, the differential reject quantity for lanes that requires separating to the "uncounted good sheet" separating assembly 72 to complete all "good sheet" stacks at the same time, the product campaign length, etc. The relevant information is considered by the stacker control system 86 and each sheet is assigned a destination. The sheets in each row are then spaced a desired distance apart in the sheet travel direction by the spacer 52, and they are spread laterally a fixed preset distance by the spreader 54; the amount of spacing and spreading is established at machine set-up.

There are several possible ways to operate the stacker to separate the reject from the good sheets. Several considerations in selecting methods are the cost to manualy handle any diverted product, the cost of the product itself, the expected quantity of handled product and the lack of randomness among the rejects, i.e., do most rejects occur in the two edge lanes of the conveyor. In some cases, the cost effective solution is to throw away good product rather than incur the cost of rehandling and counting it. Possible methods of separating the rejects and handling the remaining sheets are:

I. When a reject sheet occurs in a row, reject the entire row. This eliminates the separating conveyor and other hardware for the "uncounted good sheets" (UGS) and any recounting of UGS. All good product stacks reach full at the same time. May be cost effective for very low expected rejects and low value product.

II. When a reject sheet occurs in a row, reject the bad sheet and divert others in the row to UGS. All good product stacks reach full at the same time, and UGS must be recounted at the end of a product run.

III. When a reject sheet occurs in a row, reject the bad sheet and let others continue to good product. As each good product lane fills, divert good sheets to UGS. Recount the UGS at the end of a product run.

IV. When a reject sheet occurs in a row, divert the reject sheet and let others continue to good product. As each good product lane fills, divert good sheets to reject. No UGS separating conveyor and hardware is required and no UGS recount is required. There is a labor savings versus II and III.

A simulation of typical operating conditions using methods II, III and IV showed that if about 80% of the product lots were reject-free, method II produced better yield than method IV; below 80%, method IV was better. Method III had the best yield at 80%, which was higher than method II or IV by about 1.2%.

The novel logic providing the improved yield of method III that determines when to send a sheet to the "uncounted good sheet" (UGS) separating assembly 72 is the following. All bins, such as bin 80 in the upper tray 30, must have complete stacks of good sheets before being emptied at the same time. When a reject occurs in a first lane of sheets, it decreases the quantity in that lane so the stacks for the other lanes will fill first. However, if rejects occur in other lanes, they will not fill before the first lane. Therefore, accommodation in the stacks for each lane does not need to be made until the stack for a particular lane is full. At that point, that full lane must not receive any more sheets until the stacks for the other lanes are full, so the lane that is full must be separated to the "uncounted good sheet" separating assembly 72. This will continue and other lanes may also be separated to UGS until all lanes have full stacks in, for example, tray 30. At that point, all lanes can now stop separating to the UGS assembly 72 and start separating to the appropriate "good sheet" tray, now empty tray 32. This is significantly more efficient than correcting the stack quantity each time a reject in a single lane occurs by directing the sheets in all other lanes to the "uncounted good sheet" separating assembly 72 at the same time that the reject is separated (method II). This logic is implemented at the point of chopping the row of sheets since, at that point, the count of good sheets for all lanes is known.

After chopping, the sheet rows are spaced apart in the machine direction by a predetermined amount that is adjustable. This spacing can be fine-tuned based, for instance, upon sheet friction on the spacing conveyor and line speed to provide more time between sheets. The actual spacing achieved therefore must be confirmed by sensors 58 at the entrance to the main conveyor 62. This is depicted by box 234 in FIG. 5*a*. At this point, the destination of the sheets must be absolutely determined; there can be no changes after the sheets pass this point. One event that can change the sheet destination is whether the appropriate "good sheet" tray, 30 or 32, is ready to accept the sheet. Since there are several sheets after the sensors 58 and before the trays 30 and 32, the decision to change destination for a sheet must be made before the present tray fills. For instance, if the upper tray 30 has not been emptied and readied to accept sheets by the time the last "good sheet" for the lower tray 32 is entering the main conveyor 62, sheets which are designated as "good sheets" must be changed to UGS and the main conveyor speed reduced until the upper tray 30 is ready to accept "good sheets". This logic is shown by boxes 236, 238 and 240. If the last sheet for filling the active "good sheet" tray has not entered the main conveyor, or if the last sheet has entered and the next "good sheet" tray is emptied and ready, the predetermined sheet designation can remain unchanged and the sheets directed to their designated destination. If however, the last sheet for the active "good sheet" tray has entered the main conveyor and the next tray is not ready, the predetermined destination for the "good sheets" must be changed to "UGS" for all rows of sheets where the last sheet has entered the conveyor, as per box 240. This allows the machine to keep running while a momentary problem getting the tray ready is corrected. If this condition continues for very long, the machine would be shut down by the operator who is having trouble getting the tray ready. Different means for control of the stacker are possible, such as programmable logic controllers, computers, relay logic controllers and the like.

When any of the plurality of sensors 58 detects a sheet in a row at the entrance to the main stacker conveyor, the tracking of that row is started by counting the pulses from the main conveyor motion pulse generator 60, located on the driven conveyor shaft at the exit end 170 of the main conveyor 62. Since the shaft is positively connected to the drive roller 112 that positively engages the belts 110, 126 and 128, the motion pulse generator 60 can be said to be in operative contact with the belts 110, 126 and 128 of the main conveyor 62. The number of motion pulses, or counts, to each sheet destination is known, so the time to turn on the appropriate diverting jet is known. The jet of air should be present at the conveyor surface just after the trailing edge of the preceding sheet passes and before the leading edge of the approaching sheet arrives. The only adjustment to this destination count is to increase it or decrease it slightly based on conveyor speed, since the response time of the diverting valves and jets is a finite fixed time and the actuation may have to be advanced for high speeds so that the jets will get the diverting air to the conveyor surface in time to divert a sheet. Once the destination is assured, the row motion counter for each row is started as per box 242. Within each row, the destination of a particular sheet may be one of five possibilities as depicted by boxes 244, 246, 248, 250 and 252. The count, which represents the distance to each destination, is known and, therefore, when to turn on the jets (nozzles) for each destination is known.

The plurality of sensors 58 at the entrance to the main conveyor 62 is required so there is always a sensor in the appropriate position to detect the row for all the sheet slit width variations and lateral spacing variations. Also, the sensors 58 can be used to monitor variations in the position of the leading edge of a row to detect row skew. If excess skew is detected, the stacker control system 86 can notify the operator or shut down the machine. This function is an exception not shown on the general sheet-handling diagram of FIGS. 5*a* and 5*b*.

There is a provision in the control system 86 for detecting malfunctions in the separating assemblies, such as a separating nozzle valve sticking on or off or delaying, a jet (nozzle) blocked, or failure of the vacuum in a separating conveyor, etc. When this occurs, it may result in a sheet not separating when it was expected to be separated, or a sheet separating when it was not expected to. These unexpected sheet separating events can be detected by sensors 94 on the upper "good sheet" stacking assembly 99 and sensors 100 on the lower "good sheet" stacking assembly 98. These sensors 94 and 100 look for the presence or absence of sheets that are expected based on the predetermined destination information for each sheet. Boxes 254, 256 and 258 show the logic for detecting unexpected sheet absence or presence and notifying the operator. The "good sheet" stack that subsequently has the incorrect quantity of sheets is identified so the operator can correct the problem.

It is significant that the apparatus of this invention peels the leading edge of the sheet from one conveyor and engages the sheet with a separating conveyor while the trailing edge of the film is still held on the main conveyor. In this way, the sheet is always positively handled and is never fully released from the influence of a vacuum holding force or forces as the sheet is diverted from one conveyor to another. This assures reliable, accurate handling of the sheets, particularly flexible sheets and most particularly film sheets.

The apparatus of the invention has been described as it would be used to form stacks of sheets with each stack consisting of sheets from a single lane, wherein each lane may contain a different width sheet. In some instances, it may be advantageous to use the apparatus to form stacks of sheets with each stack consisting of sheets from several lanes, wherein each lane may contain the same width sheet. FIG. 6 shows a diagrammatic overhead view of the apparatus of the invention adapted for shuffling sheets or stacking sheets from different lanes into a single stack. The order of stacking the sheets may be repetitive or may be random based on preselected separating criteria. Sheets 68 are shown in three lanes 1, 2, and 3 of equal size sheets advancing along the main conveyor 62 in the direction of arrow 171. Above the conveyor 62 are separating assemblies 64, 72 and 74 including cross conveyor assemblies 106, 190 and 260, respectively, which are used for separating "good sheet" stacks. "Good sheet" separating assemblies 98 and 99, shown in FIG. 2, are not shown in this embodiment, although they may advantageously be used for separating samples and rejects. Cross conveyor assembly 106 feeds sheets to stack 262, assembly 190 feeds sheets to stack 264, and assembly 260 feeds sheets to stack 266. Looking at the numbered sheets from each lane in the stacks, the separating criteria may be to repetitively separate an entire row to each separating assembly which would produce stack 268 of sheets in stack 262. Alternatively, the criteria may be random as shown in stack 262 starting at sheet 270, which includes a sheet from lane 2 in a first row, followed by a sheet from lane 3 in a second row, followed by a sheet from lane 1 in a third row, etc. Correspondingly in stack 264, a remaining sheet from lane 3 in the first row is stacked at 272; and in stack 266, a last sheet from lane 1 in the first row is stacked at 274. If reject sheets are to be handled by the arrangement shown in FIG. 6, one of the separating assemblies could be designated for reject sheets only. Such explanation illustrates one alternate use of perhaps many that are possible for the instant invention.

What is claimed is:

1. A method of diverting a selected flexible sheet from a row of sheets as they are transported past a separating conveyor, comprising the steps of:

a. supporting and transporting the row of sheets with a plurality of belts positioned with spaces therebetween, said belts traveling at the same speed and having holes in each belt in communication therethrough with a source of vacuum, there being a plurality of belts under each sheet with the sheet continuously engaged by the vacuum therethrough;

b. providing a plurality of nozzles positioned at the spaces between the belts and aligned with the leading edge of the row of sheets and directed at the side of the sheets supported by the belts;

c. directing a flow of air through selected nozzles aligned with the selected sheet in the row as the leading edge of the selected sheet reaches the selected nozzles, to thereby peel the leading edge of the sheet away from the belts and separate it therefrom; and d. engaging the peeled leading edge of the selected sheet with a source of vacuum at a transport surface of a separating conveyor placed adjacent the belts such that said nozzles are also positioned directly beneath said transport surface, the transport surface traveling at the same speed and general direction as the belts and in a diverging path away from the belts, the flow of air continuing until the selected sheet is disengaged from the belts and engaged by the transport surface, thereby separating the selected sheet from the row of sheets.

2. The method of claim 1, further comprising the steps of:

e. pressing the diverted sheet between the transport surface and a driven roll; and f. blocking the air from the nozzles from flowing along the transport surface past the driven roll.

3. The method of claim 2, wherein the pressing occurs between the transport surface and a compliant nap covering the roll.

4. A method of separating individual sheets in an array of sheets transported in lanes and substantially aligned in rows on a conveyor, and combining the sheets from different lanes in a stack, comprising the steps of:

a. supporting and transporting the rows of sheets with a plurality of belts positioned with spaces therebetween, said belts traveling at the same speed and having holes in each belt in communication therethrough with a source of vacuum, there being a plurality of belts under each sheet with the sheet continuously engaged by the vacuum therethrough;

b. providing a row of nozzles positioned at the spaces between the belts and aligned with the leading edge of a row of sheets and directed at the side of the sheets supported by the belts;

c. directing a flow of air through selected nozzles in said row of nozzles aligned with a first sheet in a first lane in the row as the leading edge of the first sheet reaches the selected nozzles, to thereby peel the leading edge of the first sheet away from the lane of sheets on the belts and separate it therefrom;

d. engaging the peeled leading edge of the first sheet with a source of vacuum at a transport surface of a first separating conveyor placed adjacent the belts, the transport surface traveling at the same speed and general direction as the belts and in a diverging path away from the belts, the flow of air continuing until the first sheet is disengaged from the belts and engaged by the transport surface, thereby separating the first sheet from the row of sheets;

e. directing a flow of air through other selected nozzles in said row of nozzles aligned with a second sheet in a different one of the lanes as the leading edge of the second sheet reaches said row of nozzles, to thereby peel the leading edge of the second sheet away from the lane of sheets on the belts and separate it therefrom;

f. engaging the peeled leading edge of the second sheet with the source of vacuum at the transport surface of the first separating conveyor;

g. separating the first and the second sheets from the transport surface and transporting the sheets in a direction perpendicular to the direction of the spaced belts; and f. stacking the sheets from the plurality of lanes into a single stack, thereby combining sheets from different lanes.

* * * * *